US007695120B2

(12) United States Patent
Yasoshima

(10) Patent No.: US 7,695,120 B2
(45) Date of Patent: Apr. 13, 2010

(54) LIQUID-EJECTING HEAD AND LIQUID-EJECTING APPARATUS HAVING THE SAME

(75) Inventor: Takeshi Yasoshima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 135 days.

(21) Appl. No.: 11/972,532

(22) Filed: Jan. 10, 2008

(65) Prior Publication Data

US 2008/0211882 A1 Sep. 4, 2008

(30) Foreign Application Priority Data

Jan. 12, 2007 (JP) ..... 2007-005032

(51) Int. Cl.
*B41J 2/045* (2006.01)
*B41J 2/135* (2006.01)

(52) U.S. Cl. ..... 347/71; 347/45

(58) Field of Classification Search ..... 347/45, 347/71

See application file for complete search history.

(56) References Cited

U.S. PATENT DOCUMENTS

2007/0146438 A1* 6/2007 Tanaka et al. ..... 347/68

FOREIGN PATENT DOCUMENTS

JP 10-264383 10/1998
JP 2004-262225 9/2004

OTHER PUBLICATIONS

Wikipedia Article: Polyimide [online], [retrieved on Jul. 16, 2009], Retrieved from Internet <URL: http://en.wikipedia.org/wiki/Polyimide>.*

Wikipedia Article: Silicon Carbide [online], [retreived on Jul. 16, 2009], Retrieved from Internet <URL: http://en.wikipedia.org/wiki/Silicon_carbide>.*

* cited by examiner

*Primary Examiner*—Matthew Luu
*Assistant Examiner*—Lisa M Solomon
(74) *Attorney, Agent, or Firm*—Workman Nydegger

(57) ABSTRACT

A liquid-ejecting head including a channel-forming substrate provided with pressure-generating chambers that are communicated with nozzle openings for ejecting a liquid, pressure-generating units for generating a change in the pressure in the pressure-generating chambers, and a fluid-resistant protection film is provided. The protection film is disposed at least on the inner walls of the pressure-generating chambers and includes an amorphous layer of an amorphous film disposed on the inner wall surfaces and a crystal layer of a crystallized film disposed on the surface of the amorphous layer.

7 Claims, 5 Drawing Sheets

LIQUID-EJECTING HEAD AND LIQUID-EJECTING APPARATUS HAVING THE SAME

BACKGROUND

1. Technical Field

The present invention relates to a liquid-ejecting head and a liquid-ejecting apparatus having the same. Specifically, the invention is usefully applied to form a fluid-resistant protection film on a surface of a channel for a liquid that may etch the channel.

2. Related Art

An ink-jet recording apparatus is known as a liquid-ejecting apparatus. The ink-jet recording apparatus includes a plurality of pressure-generating chambers that generate pressure for ejecting ink droplets with a piezoelectric element or a heater element, a common reservoir for supplying an ink to each pressure-generating chamber, and an ink-jet recording head provided with nozzle openings being communicated with the respective pressure-generating chambers. Such an ink-jet recording apparatus ejects an ink droplet from a nozzle opening by applying an ejection energy to an ink in the pressure-generating chamber being communicated with the nozzle corresponding to a printing signal.

The ink-jet recording head is roughly classified into a piezoelectric vibration-type in which each of the pressure-generating chambers is partially made of a vibration plate and an ink droplet is ejected from a nozzle opening by deforming the vibration plate with a piezoelectric element and into a system in which a heater element such as a resistance heating wire that generates Joule heat according to a driving signal is disposed inside each of the pressure-generating chambers and an ink droplet is ejected from a nozzle opening by means of a bubble generated by the heater element.

In these known ink-jet recording heads, the pressure-generating chambers are generally formed on a silicon substrate. If an alkaline ink is used, the ink gradually dissolves the silicon substrate and, thereby, the width of each pressure-generating chamber changes with a lapse of time. This causes a change in the pressure that is applied to the pressure-generating chamber by driving a piezoelectric element or a heater element, resulting in a gradual deterioration in the ink ejection characteristics.

In order to solve the above-mentioned problems, it is proposed to form a film having hydrophilicity and alkali resistance, such as a nickel film, inside the pressure-generating chambers for preventing the silicon substrate from being dissolved in the ink (refer to, for example, FIG. 1 and paragraph [0020] of JP-A-10-264383).

However, such a nickel film is poor in long-term stability. Accordingly, in order to solve this problem, a tantalum oxide film is proposed as the protection film (refer to, for example, FIG. 1 and paragraph [0032] of JP-A-2004-262225). The above-mentioned protection films are each formed as an amorphous film for good adhesion to the silicon substrate. That is because a crystallized film has a high stress of its own and, thereby, the adhesion is generally low.

However, the known protection films described above have a single amorphous layer structure and may hence have pinhole defects. Therefore, the protection film is required to have a thickness excessively large, in order to avoid the occurrence of pinhole defects. Since a protection film having a larger thickness tends to inhibit displacement of a piezoelectric element and therefore badly affects the vibration characteristics of the piezoelectric element.

SUMMARY

An advantage of some aspects of the invention is to provide a liquid-ejecting head having a protection film that secures good adhesion but does not have defects and to provide a liquid-ejecting apparatus having the head.

The above-mentioned advantage of the invention is achieved by a liquid-ejecting head including a channel-forming substrate being provided with pressure-generating chambers communicated with nozzle openings for ejecting a liquid; a pressure-generating units for generating a change in the pressure in the pressure-generating chambers; and a fluid-resistant protection film, wherein the protection film is disposed at least on the inner walls of the pressure-generating chambers and includes an amorphous layer of an amorphous film disposed on the inner wall surfaces and a crystal layer of a crystallized film disposed on the surface of the amorphous layer.

According to the invention, the adhesion of the protection film to the inner wall is secured by the amorphous layer, and even if pinholes are formed in the amorphous layer, the crystal layer can cover the pinhole defects. Thus, the protection film substantially not having pinhole defects can be formed and protect the inner wall, while securing a good adhesion to the inner wall thereof.

As a result, certain ink resistance characteristics can be stably maintained over a long time. In addition, the protection film can be reduced in the thickness, which can improve the productivity of the liquid ejecting head.

The pressure-generating unit can preferably employ a piezoelectric element that changes the volume of the pressure-generating chamber by displacement of itself according to a driving signal.

In such a case, not only the productivity of the liquid-ejecting head is particularly improved by reducing the thickness of the protection film, but also desired characteristics can be sufficiently achieved, without inhibiting displacement of the pressure-generating unit.

The liquid-ejecting head includes liquid channels for supplying a liquid to the pressure-generating chambers on the channel-forming substrate. The protection film may be disposed on the inner walls of the liquid channels.

With the protection film, certain ink resistance characteristics can be stably provided to the inner walls of the liquid channels, too, over a long time.

Furthermore, in the above liquid-ejecting head, the crystal layer preferably has a thickness thinner than that of the amorphous layer.

With this, the protection film can be thinned as much as possible while the most important function, namely, the removal of pinhole defects in the amorphous layer, can be secured. The reduction in the thickness can prevent a decrease in displacement of the pressure-generating unit and thereby is significantly effective, particularly when the pressure-generating unit employs a piezoelectric element. That is, the thickness of the crystal layer is a factor that highly affects displacement of the pressure-generating unit, because of the characteristic that the stress of the crystal layer itself is relatively large compared to that of the amorphous layer.

Furthermore, in the above liquid-ejecting head, the protection film may be composed of a plurality of alternately stacked amorphous layers and crystal layers. With this, pinhole defects can be certainly removed from the protection film.

The invention also provides a liquid-ejecting apparatus having the above-described liquid-ejecting head.

According to the present invention, a liquid-ejecting apparatus of which liquid ejection characteristics are well and stable over a long time can be achieved.

DESCRIPTION OF EXEMPLARY EMBODIMENTS

Embodiments according to the invention will be described in detail with reference to the accompanying drawings.

Liquid-Ejecting Head According to a First Embodiment

Figure 1:
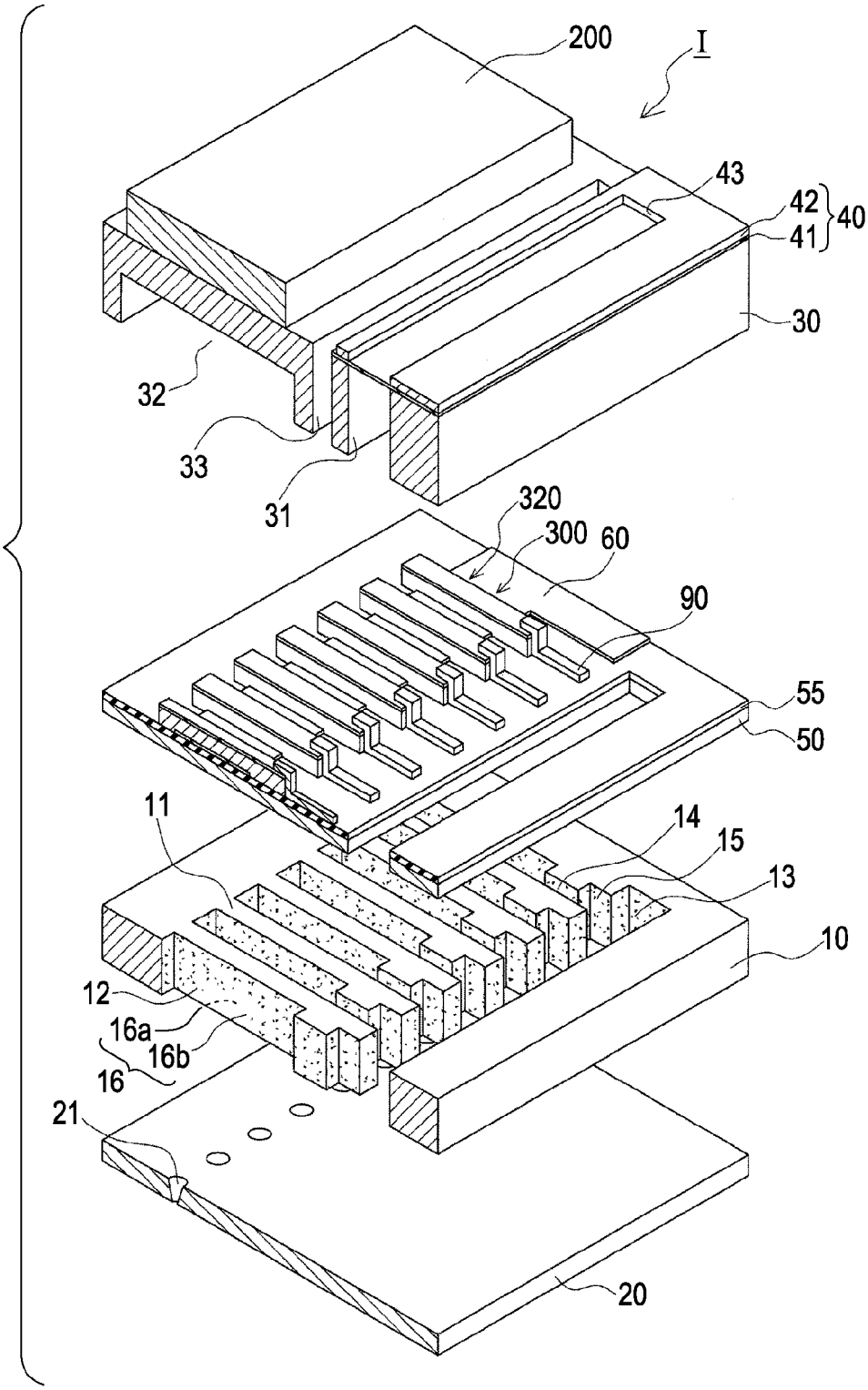
FIG. 1 is an exploded perspective view of a recording head according to an embodiment of the invention.
Figure 2:
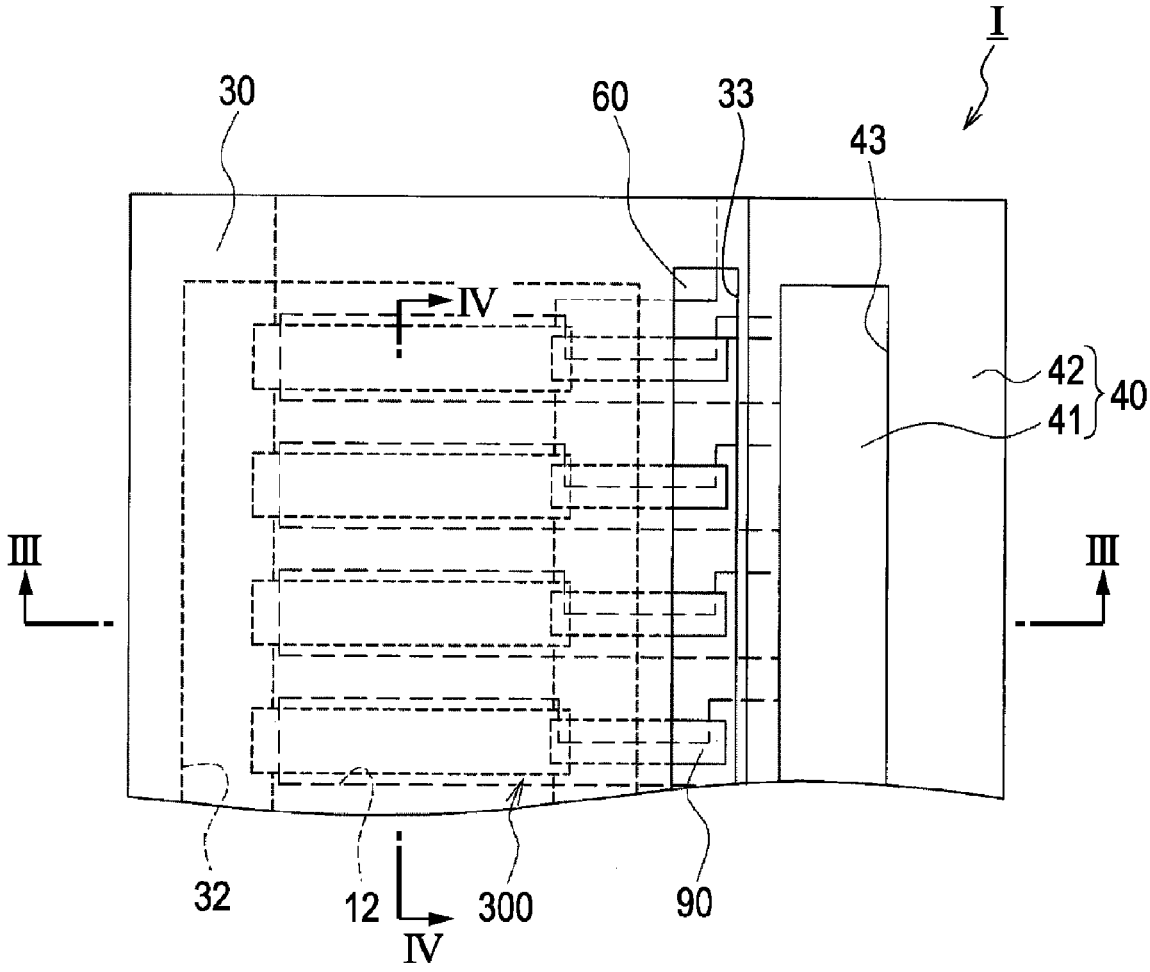
FIG. 2 is a plan view of the recording head of FIG. 1.
Figure 3:
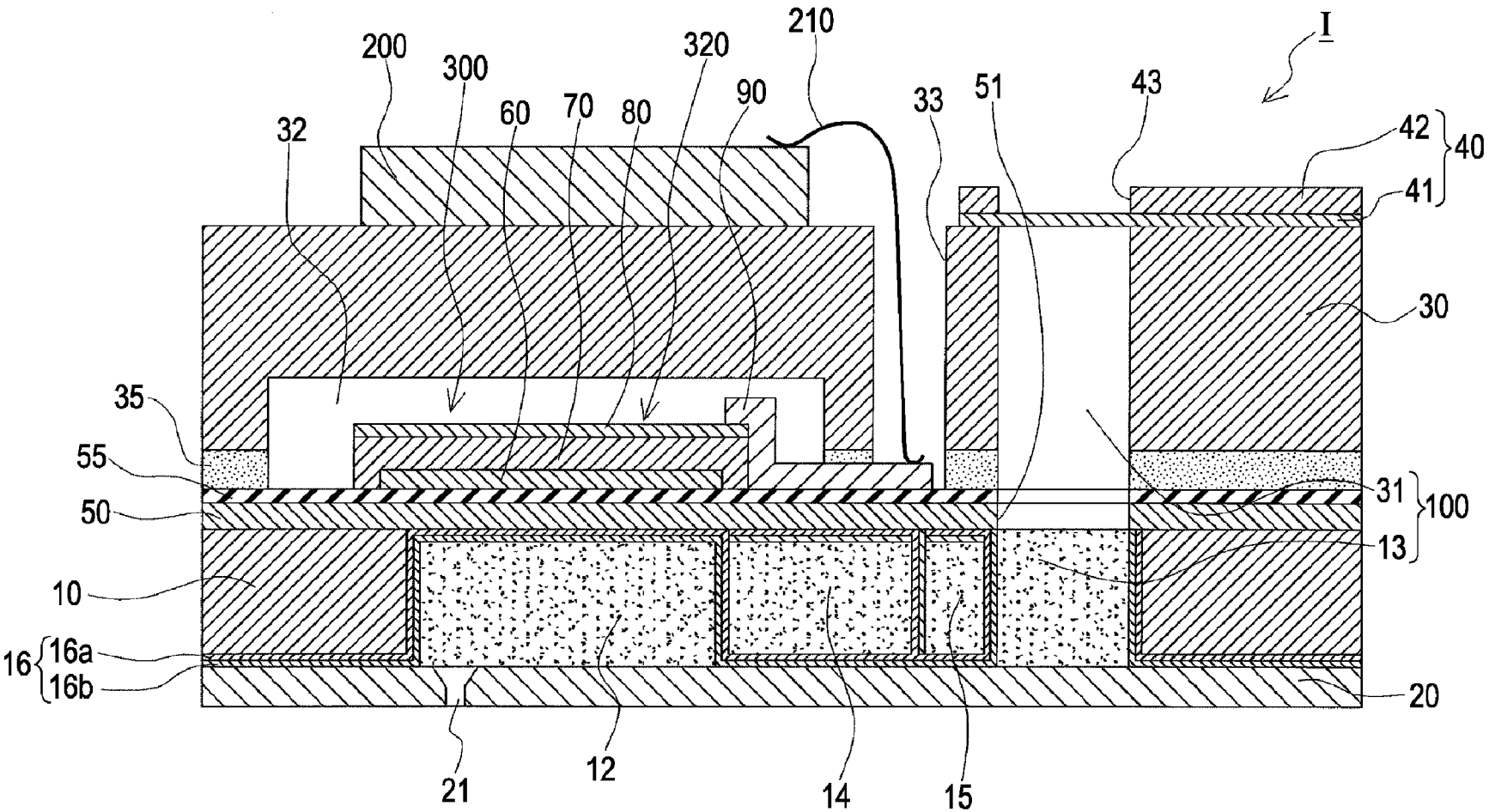
FIG. 3 is an enlarged cross-sectional view taken along the line III-III in FIG. 2.
Figure 4:
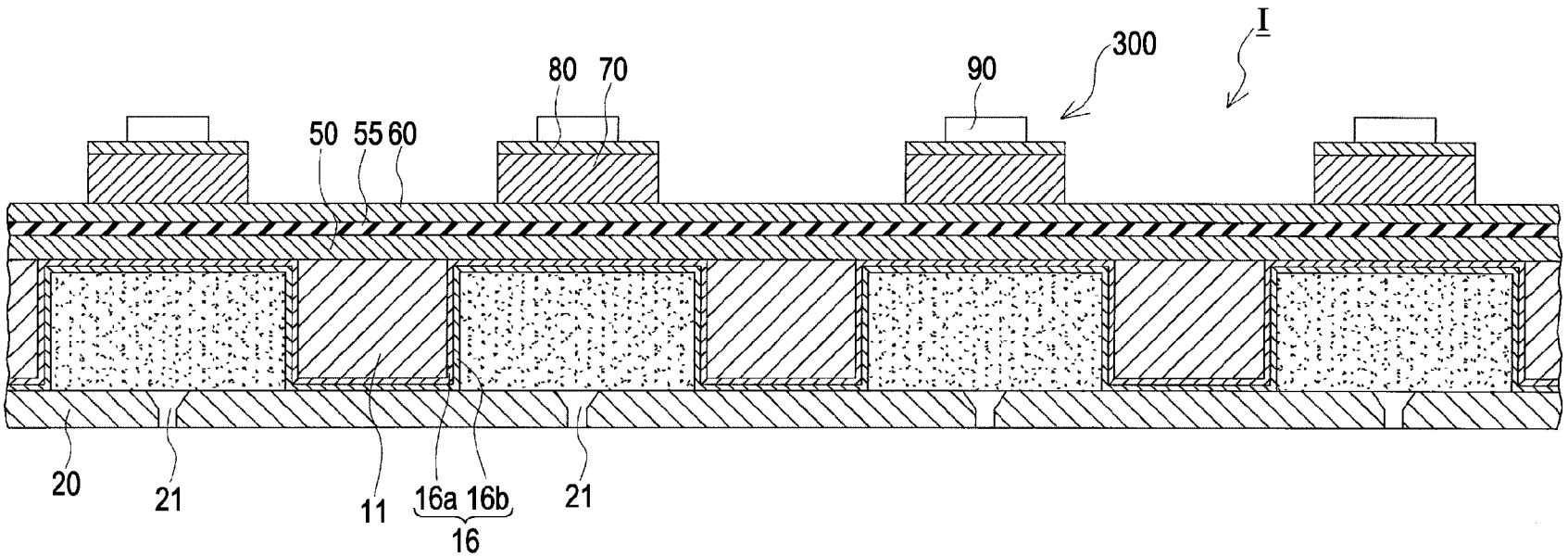
FIG. 4 is a partially enlarged cross-sectional view taken along the line IV-IV in FIG. 2.

FIG. 1 is an exploded perspective view schematically illustrating the structure of an ink-jet recording head according to an embodiment of the invention. FIG. 2 is a plan view of the recording head of FIG. 1. FIG. 3 is an enlarged cross-sectional view taken along the line III-III in FIG. 2, and FIG. 4 is a partially enlarged cross-sectional view taken along the line IV-IV in FIG. 2.

In the ink-jet recording head I according to this embodiment shown in these drawings, the channel-forming substrate 10 is made of a single-crystal silicon substrate with a crystal plane direction of the (110) plane. Furthermore, an elastic film 50 made of silicon dioxide and having a thickness of 0.5 to 2 μm is previously formed on one surface of the channel-forming substrate 10 by thermal oxidation.

The channel-forming substrate 10 is provided with pressure-generating chambers 12 that are partitioned by a plurality of partition walls 11. The pressure-generating chambers 12 are formed by anisotropically etching the channel-forming substrate 10 from the other side than the elastic film 50 side so as to be disposed in parallel in the width direction (widthwise direction) of the substrate 10. Furthermore, ink supply channels 14 and communicating channels 15 are partitioned by the partition walls 11 at one end side in the longitudinal direction of the pressure-generating chambers 12 of the channel-forming substrate 10. In addition, a communicating portion 13 is formed at one end side of the communicating channels 15 to constitute a part of a reservoir 100 that functions as an ink chamber (liquid chamber) common for the pressure-generating chambers 12. That is, the channel-forming substrate 10 is provided with a liquid channel including the pressure-generating chambers 12, the communicating portion 13, the ink supply channels 14, and the communicating channels 15.

Each of the ink supply channels 14 is communicated with the one end of the corresponding pressure-generating chamber 12 in the longitudinal direction and has a cross-sectional area smaller than that of the pressure-generating chamber 12. For example, in this embodiment, the ink supply channels 14 are formed in fluid channels between the reservoir 100 and the pressure-generating chambers 12 at the pressure-generating chambers 12 sides so as to have a width smaller than those of the pressure-generating chambers 12 by narrowing the fluid channels in the width direction. The ink supply channels 14 maintain a constant flow resistance of ink that flows in the pressure-generating chambers 12 from the communicating portion 13. Furthermore, in this embodiment, the ink supply channels 14 are formed by narrowing the width of the channels from one side, as described above, but may be formed by narrowing the width of the channels from both sides. Alternatively, the ink supply channels 14 may be formed by narrowing the channels in the thickness direction.

Each of the ink supply channels 14 is communicated with the corresponding communicating channel 15 at the other side than the pressure-generating chamber 12 side. The communicating channel 15 has a cross-sectional area larger than that of the ink supply channel 14 in the width direction (widthwise direction). In this embodiment, the communicating channel 15 has the same cross-sectional area as that of the pressure-generating chamber 12. That is, the channel-forming substrate 10 is provided with the pressure-generating chambers 12, the ink supply channels 14 each having a cross-sectional area smaller than that of the pressure-generating chamber 12 in the widthwise direction, and the communicating channels 15 being communicated with the corresponding ink supply channels 14 and each having a cross-sectional area larger than that of the ink supply channel 14 in the widthwise direction, by being partitioned by a plurality of partition walls 11.

Here, the inner surfaces of the pressure-generating chambers 12, the communicating portion 13, the ink supply channels 14, and the communicating channels 15 of the channel-forming substrate 10 are each provided with a protection film 16 having a predetermined thickness. The protection film 16 is made of a material having ink resistance, for example, tantalum oxide such as tantalum pentoxide ($Ta_2O_5$). The term "ink resistance" means etching resistance against an alkaline ink.

The protection film 16 in this embodiment is composed of an amorphous layer 16*a* of an amorphous (non-crystalline) film formed on the inner wall surfaces of the pressure-generating chambers 12, the communicating portion 13, the ink supply channels 14, and the communicating channels 15 and crystal layer 16*b* of a crystalline film formed on the surface of the amorphous layer 16*a*. With such a multi-layer structure, good adhesion to the inner wall surfaces is surely secured and, at the same time, pinhole defects can be removed. That is, the good adhesion to the channel-forming substrate 10 is secured by the amorphous layer 16*a* that readily develops pinhole defects but is excellent in adhesion, and the generated pinhole defects are substantially removed by covering the amorphous layer 16*a* with the crystal layer 16*b* that is poor in adhesion but hardly develops pinhole defects.

The protection film 16 made of tantalum oxide typified by tantalum pentoxide ($Ta_2O_5$) has very excellent ink resistance against an ink, in particular, against an alkaline ink. Thus, the protection film 16 made of tantalum oxide has very excellent ink resistance against an ink with a relatively high alkalinity and, therefore, is specifically effective to inks used in ink-jet recording heads. For example, the protection film 16 made of tantalum pentoxide according to this embodiment had an etching rate of 0.03 nm/day in an ink with a pH of 9.1 at 25° C. Desirably, the etching rate in an ink with a pH of 8.0 or more is 0.05 nm/day or less at 25° C., from the viewpoint of ink resistance.

Since the protection film 16 made of tantalum pentoxide is disposed at least on inner wall surfaces of the pressure-generating chambers 12, the channel-forming substrate 10 and a vibration plate are prevented from being dissolved in ink. With this, the shapes of the pressure-generating chambers 12 can be substantially stabilized. That is, approximately the same shapes as those when they were manufactured can be maintained. Furthermore, in this embodiment, the protection film 16 is also disposed on inner wall surfaces of fluid channels, i.e., the communicating portion 13, the ink supply channels 14, and the communicating channels 15, in addition to the pressure-generating chambers 12. Accordingly, the shapes of these channels, namely, the communicating portion 13, the ink supply channels 14, and the communicating channels 15, are maintained approximately the same as those when they were manufactured, for the same reason as in the pressure-generating chambers 12.

Consequently, certain ink ejection characteristics can be maintained over a long time by the protection film 16 that has a multi-layer structure for stabilizing the function. Furthermore, the protection film 16 prevents the channel-forming substrate 10 from being dissolved in an ink. As a result, the amount of precipitate of the dissolved matter of the channel-forming substrate 10 in the ink is substantially decreased. With this, the occurrence of nozzle clogging can be prevented and thereby ink droplets can be well ejected from nozzle openings 21.

As described above, in this embodiment, the protection film 16 has a multi-layer structure of the amorphous layer 16*a* and the crystal layer 16*b*. Such a film can be well formed by any known method, for example, by a plasma CVD method, a sputtering method, or an evaporation method. The amorphous layer 16*a* and the crystal layer 16*b* can be distinctively formed by optionally selecting film-forming conditions. In general, crystallization progresses with an increase in the energy of a factor assisting the forming of a film, such as plasma or heat. The protection film 16 may be formed of, for example, zirconium oxide ($ZrO_2$), nickel (Ni), or chromium (Cr), depending on the pH value of an ink used. However, significantly excellent ink resistance can be achieved by using tantalum oxide, allowing the use of an ink having a high pH value.

In addition, the amorphous layer 16*a* may have pinhole defects as long as the adhesion is secured, and the crystal layer 16*b* may be any film that can cover the pinhole defects in the amorphous layer 16*a*. As a result, the protection film 16 can be reduced in the thickness compared to existing films. The crystal layer 16*b* may have a thickness thinner than that of the amorphous layer 16*a*, as long as the most important function of the crystal layer 16*b*, namely, removal of pinhole defects of the amorphous layer 16*a*, is secured. Accordingly, the thickness of the crystal layer 16*b* with a high internal stress can be reduced as much as possible.

Furthermore, in this embodiment, the protection film 16 is also disposed on the surface of the channel-forming substrate 10 at the side where the openings of pressure-generating chambers 12 are formed. The channel-forming substrate 10 is joined to a nozzle plate 20 via this protection film 16, and thereby the adhesion strength between the both is improved. However, since the surface joined to the nozzle plate 20 is substantially not brought into contact with an ink, the protection film 16 may not be provided.

Furthermore, in this embodiment, the ink-resistant protection film 16 is disposed on the inner wall surfaces of the pressure-generating chambers 12, the communicating portion 13, the ink supply channels 14, and the communicating channels 15, but the present invention is not limited thereto as long as the protection film 16 is disposed at least on the inner wall surfaces of the pressure-generating chambers 12. Even in such a structure, constant ink ejection characteristics can be maintained over a long time.

Furthermore, in this embodiment, the channel-forming substrate 10 is fixed to the nozzle plate 20 with an adhesive, a thermal adhesive film, or the like at the side where the openings are provided. The nozzle plate 20 has nozzle openings 21 that are each communicated with the corresponding pressure-generating chambers 12 in the vicinity of the ends at the opposite side of the pressure-generating chambers 12 than the side where the ink supply channels 14 is provided. The nozzle plate 20 in this embodiment is made of, for example, glass ceramics, a single-crystal silicon substrate, or a stainless steel.

Furthermore, as described above, the elastic film 50, for example, made of silicon dioxide and having a thickness of about 1.0 μm is disposed on the opposite side of the channel-forming substrate 10 than the side where the openings are provided. On this elastic film 50, an insulator film 55, for example, made of zirconium oxide ($ZrO_2$) and having a thickness of about 0.4 μm is disposed. Furthermore, on this insulator film 55, a piezoelectric element 300 functioning as a pressure-generating unit is disposed. The piezoelectric element 300 includes, for example, a lower electrode film 60 having a thickness of about 0.1 to 0.5 μm, a piezoelectric layer 70 of a piezoelectric film made of, for example, lead zirconium titanate (PZT) and having a thickness of about 1.1 μm, and an upper electrode film 80 having a thickness of about 0.05 μm, which are layered in sequence. The piezoelectric element 300 in this embodiment means a portion including the lower electrode film 60, the piezoelectric layer 70, and the upper electrode film 80. In general, either of the electrodes of each piezoelectric element 300 is formed as a common electrode, and the other electrode and the piezoelectric layer 70 are formed by patterning for each pressure-generating chamber 12. In this embodiment, a portion that is constituted by the electrode and the piezoelectric layer 70 formed by patterning and generates piezoelectric strain by applying a voltage to both electrodes is referred to as a piezoelectric active portion 320.

In this embodiment, the lower electrode film 60 is formed as a common electrode of the piezoelectric elements 300, and the upper electrode films 80 are formed as individual electrodes of the piezoelectric elements 300. However, the relationship between the electrodes may be reversed depending on a driving circuit or wiring. In both cases, each pressure-generating chamber 12 is provided with the individual piezoelectric active portion 320. Furthermore, in this embodiment, the piezoelectric element 300 and a vibration plate in which displacement occurs by driving the piezoelectric element 300 are collectively referred to as an actuator. In the example described above, the elastic film 50, the insulator film 55, and the lower electrode film 60 function as the vibration plate. However, the vibration plate may be formed of the lower electrode film 60 alone, without that the elastic film 50 and the insulator film 55 are provided. Alternatively, the piezoelectric element 300 itself may be substantially imparted with a function as the vibration plate. The upper electrode films 80 of the piezoelectric elements 300 are connected to the corresponding lead electrodes 90, and the piezoelectric elements 300 are each selectively applied with a voltage via this lead electrode 90.

Furthermore, a protecting substrate 30 is joined to the channel-forming substrate 10 at the piezoelectric element 300 side. The protecting substrate 30 includes a reservoir portion 31 that is at least a part of the reservoir 100. In this embodiment, the channel-forming substrate 10 and the protecting substrate 30 are joined to each other with an adhesive 35.

The reservoir portion 31 of the protecting substrate 30 is communicated with the communicating portion 13 of the channel-forming substrate 10 via a penetrating portion 51 disposed in the elastic film 50 functioning as the vibration plate. The reservoir portion 31 and the communicating portion 13 form the reservoir 100 that is a common liquid chamber for the plurality of pressure-generating chambers 12. However, the communicating portion 13 of the channel-forming substrate 10 may be partitioned so as to correspond to the respective pressure-generating chambers 12, and the reservoir portion 31 alone may function as the reservoir 100. Alternatively, for example, the channel-forming substrate 10 is provided with only the pressure-generating chambers 12, and the members (for example, the elastic film 50 and the insulator film 55) lying between the channel-forming substrate 10 and the protecting substrate 30 may be provided with ink supply channels 14 that connect the pressure-generating chambers 12 to the reservoir 100.

The protecting substrate 30 has a piezoelectric element-holding portion 32 at the region facing the piezoelectric elements 300. The piezoelectric element-holding portion 32 is a space not to inhibit the motion of the piezoelectric elements 300 and may be sealed or not sealed. In addition, a penetrating hole 33 passing through the protecting substrate 30 in the thickness direction is disposed between the piezoelectric element-holding portion 32 and the reservoir portion 31 of the protecting substrate 30. A part of the lower electrode film 60 and the tips of the lead electrodes 90 are exposed to the inside of the penetrating hole 33. The protecting substrate 30 is made of, for example, glass, a ceramic material, a metal, or a resin, and is preferably made of a material having approximately the same thermal expansion rate as that of the channel-forming substrate 10. In this embodiment, the protecting substrate 30 is made of the same material, a single-crystal silicon substrate, as that of the channel-forming substrate 10.

A driving circuit 200 for driving the piezoelectric elements 300 is disposed on the protecting substrate 30. The driving circuit 200 can be preferably constituted by, for example, a semiconductor integrated circuit (IC). This driving circuit 200 is electrically connected to the lead electrodes 90 with connection wiring lines 210 of a conductive wire such as a bonding wire. The reservoir portion 31 of the protecting substrate 30 may be provided with the above-described protection film 16 on the inner wall surface thereof. The protection film 16 can prevent the protecting substrate 30 from being etched by an ink.

Furthermore, a compliance substrate 40 including a sealing film 41 and a fixing plate 42 is joined to the protecting substrate 30 in the region corresponding to the reservoir portion 31. The sealing film 41 is made of a material having a low rigidity and having flexibility (for example, a polyphenylene sulfide (PPS) film having a thickness of 6 μm) and seals the one side of the reservoir portion 31. The fixing plate 42 is made of a hard material such as a metal (for example, a stainless steel (SUS) having a thickness of 30 μm). The region opposing to the reservoir 100 of the fixing plate 42 is removed completely in the thickness direction to form an opening portion 43 so that one side of the reservoir 100 is sealed with the flexible sealing film 41 alone.

The ink-jet recording head I according to this embodiment is supplied with an ink from an external ink supply unit (not shown). Firstly, the inside of the ink-jet recording head I from the reservoir 100 to the nozzle openings 21 has been filled with an ink. Then, a voltage is applied between the lower electrode film 60 and the upper electrode film 80 corresponding to a pressure-generating chamber 12, according to a recording signal from the driving circuit 200. The application of the voltage causes deformation of the piezoelectric element 300 and the vibration plate to increase the pressure in the pressure-generating chamber 12. As a result, the ink is ejected from the nozzle opening 21.

The adhesion of the protection film 16 to the channel-forming substrate 10 is secured by the amorphous layer 16*a*. Furthermore, even if pinhole defects occur in the amorphous layer 16*a*, the crystal layer 16*b* covers the pinhole defects. Therefore, the protection film 16 can be formed so as substantially not to have pinhole defects while securing the well adhesion of the film to the inner wall of the channel-forming substrate 10.

As in this embodiment, in a case that the pressure-generating unit is formed of a piezoelectric element 300 that changes the volume of the pressure-generating chamber 12 by displacement of itself, the desired characteristics can be sufficiently achieved by reducing the thickness of the protection film 16, particularly without inhibiting displacement of the piezoelectric element 300. Moreover, in a case that the thickness of the crystal layer 16*b*, which is a factor inhibiting displacement of the piezoelectric element 300 because of its high internal stress, is thinner than that of the amorphous layer 16*a*, the affect on displacement of the piezoelectric element 300 can be reduced as much as possible.

Liquid-Ejecting Head According to a Second Embodiment

The invention is not limited to the embodiment described above. In the first embodiment, the crystal layer 16*b* is disposed on the surface of the amorphous layer 16*a*. However, for example, the protection film 16 further includes another multi-layer structure of the amorphous layer 16*a* and the crystal layer 16*b*. Pinhole defects can be removed more securely as an increase in the number of the layers. In general, the outermost layer in such a layered structure may be either of the amorphous layer 16*a* or the crystal layer 16*b*.

In the first embodiment, the piezoelectric element 300 used as the pressure-generating unit generating a change in the pressure in the pressure-generating chamber 12 is a thin-film actuator, but the present invention is not limited thereto. For example, another actuator such as a thick-film actuator formed by a method laminating green sheets or a longitudinal vibration-mode actuator in which a piezoelectric material and an electrode material are alternately layered and the expansion in the axial direction is performed can be similarly used. Moreover, the pressure-generating unit may be a bubble actuator in which a heating element is disposed in the pressure-generating chamber and a liquid droplet is ejected from a nozzle opening by means of a bubble generated by the heat of the heating element, or an electrostatic actuator in which static electricity is generated between a vibration plate and an electrode and deforms the vibration plate to eject a liquid droplet from a nozzle opening.

The present invention broadly relates to the entire liquid-ejecting head and can be also applied to a liquid-ejecting head ejecting a liquid other than inks. Examples of such the liquid-ejecting head include various types of recording heads used in image recording apparatuses such as printers, color material-ejecting heads used for manufacturing color filters of liquid crystal displays, electrode material-ejecting heads used for forming electrodes of organic EL displays or FEDs (field emission displays), and bioorganic material-ejecting heads used for manufacturing biochips.

Furthermore, in the first embodiment, the protection film 16 is provided to the channel-forming substrate 10 being a silicon substrate, and alkaline inks are used, but the invention is not limited thereto. Any fluid-resistant protection film that can achieve etching resistance to a predetermined liquid can be used, and the subject matter to be provided with the protection film and the liquid to be ejected are not specifically limited.

Figure 5:
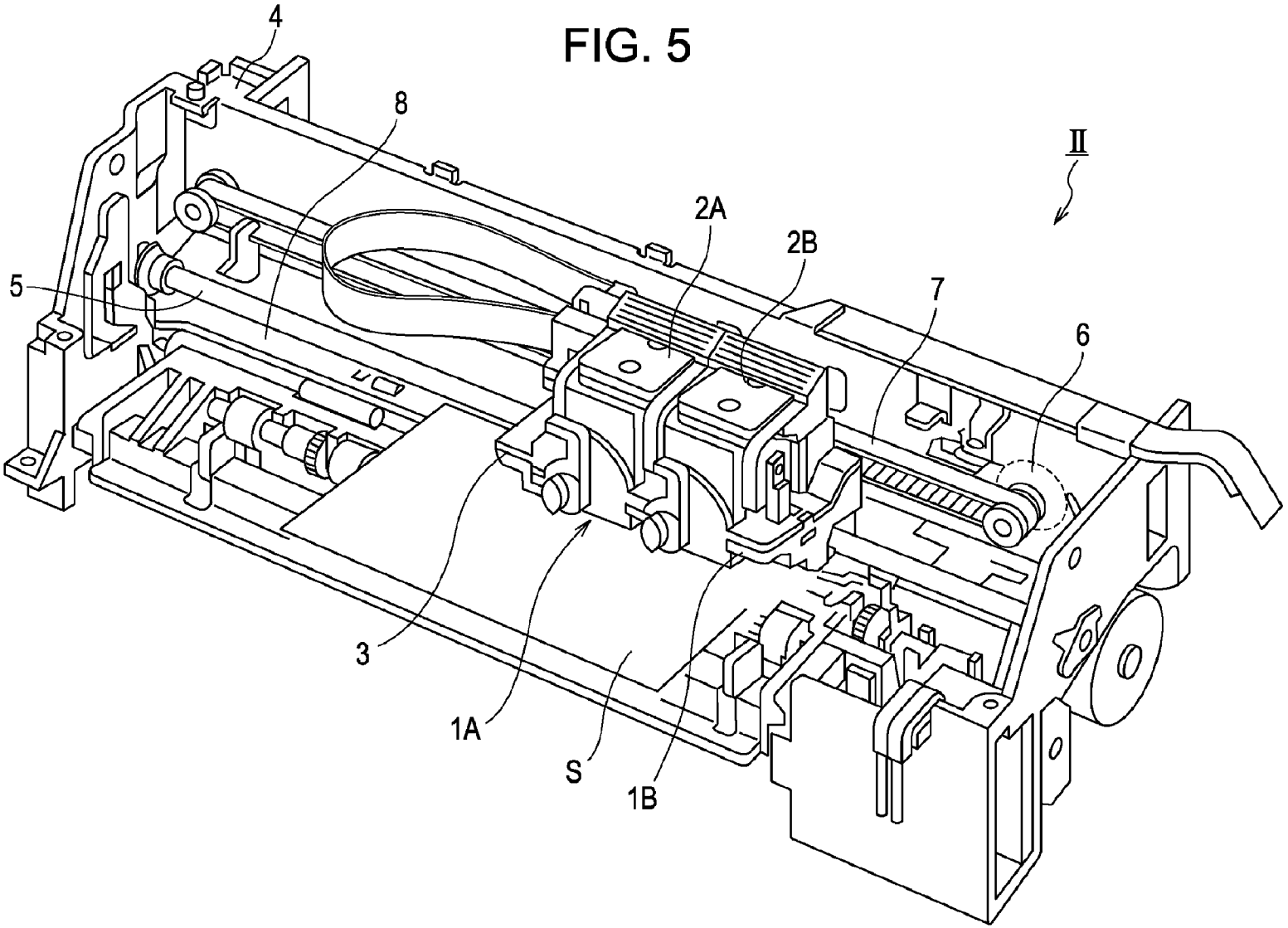
FIG. 5 is a diagram schematically illustrating an ink-jet recording apparatus according to an embodiment of the invention.

Ink-Jet Recording Apparatus Including Liquid-Ejecting Head According to the Embodiment of the Invention An ink-jet recording head I according to an embodiment of the invention constitutes a part of a recoding head unit that includes an ink channel being communicated with an ink cartridge and is mounted on an ink-jet recording apparatus II. FIG. 5 is a diagram schematically illustrating an ink-jet recording apparatus II. As shown in the drawing, recording head units 1A and 1B each having the ink-jet recording head I according to an embodiment of the invention are provided with detachable cartridges 2A and 2B, respectively, functioning as ink supply units. A carriage 3 loaded with the recording heads 1A and 1B is disposed on a carriage shaft 5 fixed to the apparatus body 4 so as to be movable in the axial direction. The recording head units 1A and 1B eject, for example, a black ink composition and a color ink composition, respectively.

The driving force of a driving motor 6 is transferred to the carriage 3 via a plurality of gears (not shown) and a timing belt 7, so that the carriage 3 loaded with the recording head units 1A and 1B is transferred along the carriage shaft 5. The apparatus body 4 is provided with a platen 8 along the carriage shaft 5. A recording sheet S, which is a recording medium such as paper supplied by a paper supply roller (not shown), is reeled to the platen 8 and is transferred.

What is claimed is:

1. A liquid-ejecting head comprising:

a channel-forming substrate provided with pressure-generating chambers that are communicated with nozzle openings for ejecting a liquid;

pressure-generating units for generating a change in the pressure in the pressure-generating chambers; and a fluid-resistant protection film, wherein the fluid-resistant protection film is disposed at least on the inner walls of the pressure-generating chambers and includes an amorphous layer of an amorphous film disposed on the inner wall surfaces and a crystal layer of a crystallized film disposed on the surface of the amorphous layer, wherein both the amorphous film and crystal layer are tantalum oxide.

2. The liquid-ejecting head according to claim 1, wherein the pressure-generating units employ a piezoelectric element that changes the volume of the corresponding pressure-generating chamber by displacement of itself according to a driving signal.

3. The liquid-ejecting head according to claim 1, wherein the channel-forming substrate is provided with fluid channels for supplying a liquid to the pressure-generating chambers, and the protection film is disposed on the inner walls of the fluid channels.

4. The liquid-ejecting head according to claim 1, wherein the crystal layer has a thickness thinner than that of the amorphous layer.

5. The liquid-ejecting head according to claim 1, wherein the protection film includes a plurality of the amorphous layers and the crystal layers alternately stacked.

6. A liquid-ejecting apparatus comprising the liquid-ejecting head according to claim 1.

7. The liquid-ejecting head according to claim 1, wherein the tantalum oxide of the amorphous film and crystal layer is tantalum pentoxide.

* * * * *